US010123607B1

(12) United States Patent
Hardy

(10) Patent No.: US 10,123,607 B1
(45) Date of Patent: Nov. 13, 2018

(54) WEARABLE LIQUID DISPENSER

(71) Applicant: Elise Nicole Hardy, Parkton, MD (US)

(72) Inventor: Elise Nicole Hardy, Parkton, MD (US)

( * ) Notice: Subject to any disclaimer, the term of this patent is extended or adjusted under 35 U.S.C. 154(b) by 0 days.

(21) Appl. No.: 15/897,012

(22) Filed: Feb. 14, 2018

(51) Int. Cl.

| | |
|---|---|
| ***A46B 5/02*** | (2006.01) |
| ***A45D 33/33*** | (2006.01) |
| ***A45D 33/12*** | (2006.01) |
| ***A45D 34/04*** | (2006.01) |
| ***A45D 40/26*** | (2006.01) |
| *A44C 5/00* | (2006.01) |
| *A45D 34/06* | (2006.01) |
| *A45D 40/18* | (2006.01) |

(52) U.S. Cl.
CPC ..... *A45D 33/33* (2013.01); *A45D 33/12* (2013.01); *A45D 34/041* (2013.01); *A45D 40/261* (2013.01); *A44C 5/003* (2013.01); *A45D 34/06* (2013.01); *A45D 40/18* (2013.01)

(58) Field of Classification Search
CPC ..... A44C 5/003; A45D 33/12; A45D 33/33; A45D 40/18; A45D 40/261; A45D 34/041; A45D 34/06
USPC ..... 401/6–8
See application file for complete search history.

(56) References Cited

U.S. PATENT DOCUMENTS

| | | | | |
|---|---|---|---|---|
| 2,122,580 | A | 7/1938 | Morris | |
| D164,327 | S | 8/1951 | Roehrich | |
| 4,571,106 | A | 2/1986 | Scuderi | |
| 4,768,688 | A | 9/1988 | Harrigan | |
| 4,952,090 | A | 8/1990 | Richardson | |
| 5,526,960 | A | 6/1996 | Breidenbach et al. | |
| 5,586,694 | A | 12/1996 | Breidenbach et al. | |
| 5,622,293 | A | 4/1997 | LeFevre | |
| 5,938,363 | A | 8/1999 | Timms et al. | |
| 6,276,853 | B1 | 8/2001 | Breidenbach et al. | |
| 7,316,128 | B1 * | 1/2008 | Dargusch | A44C 5/003 63/1.14 |
| 7,766,193 | B2 | 8/2010 | Stollmann et al. | |
| 8,708,194 | B2 * | 4/2014 | Pascatore | B65D 83/005 222/1 |
| 8,950,632 | B2 | 2/2015 | Ciavarella et al. | |
| 9,693,607 | B2 * | 7/2017 | Imbriani | A45D 33/33 |
| 2002/0071707 | A1 | 6/2002 | Breidenbach et al. | |

(Continued)

FOREIGN PATENT DOCUMENTS

| | | |
|---|---|---|
| GB | 26047 | 6/1911 |
| GB | 2536911 A | 10/2016 |
| WO | 2015189866 A1 | 12/2015 |

*Primary Examiner* — Jennifer C Chiang
(74) *Attorney, Agent, or Firm* — PK Patent Law

(57) ABSTRACT

A wearable dispenser device is provided. The dispenser can include a flexible tubular member including a first end and a second end and an interior of the flexible tubular member defines a reservoir. A first end assembly can be arranged at the first end of the tubular member. A second end assembly can be arranged at the second end of the tubular member. The first end assembly can include a valve member configured to allow a liquid to be supplied into the reservoir. The second end assembly can include a rollerball mechanism configured to allow the liquid to be accurately dispensed from the reservoir via a rollerball. The first end assembly is capable of being releasably secured to the second end assembly via a releasable connection thereby allowing the dispensing device to be worn about a body part of a user.

17 Claims, 2 Drawing Sheets

(56) References Cited

U.S. PATENT DOCUMENTS

| | | | | |
|---|---|---|---|---|
| 2006/0219742 | A1 | 10/2006 | Chen | |
| 2008/0236195 | A1 | 10/2008 | Woebke | |
| 2011/0139823 | A1 | 6/2011 | Staudt | |
| 2015/0129616 | A1 | 5/2015 | Ciavarella et al. | |
| 2016/0295976 | A1* | 10/2016 | Maynard ..... | A44C 5/003 |

* cited by examiner

WEARABLE LIQUID DISPENSER

FIELD OF THE INVENTION

The present teachings relate to a dispenser for liquids. In particular, the present teachings relate to a dispenser for dispensing liquids which can be adapted to be worn on a person or thing.

BACKGROUND OF THE INVENTION

Containers for liquids such as perfumes, oils, moisturizers, suntan lotions, and the like are currently well-known in the art. Typically, these containers are in the form of glass or plastic bottles having a dispensing outlet at the top of the bottle.

Many cosmetics need to be frequently re-applied throughout the day since they begin losing their effectiveness as soon as they are applied. As a result, it is desirable to have ready access to these products. However, many containers are not convenient to carry and if they can be carried they do not provide a way to accurately and neatly apply the cosmetics to the skin of the user. Moreover, known containers do not possess pleasing aesthetic attributes when they are carried by the user.

Accordingly, there exists a need for a dispenser which can be easily worn by the user, allows accurate and precise application of the liquid, is refillable, and carries a satisfactory quantity of fluid. There is also a need for a dispenser that is attractive and fashionable when it is being worn by the user.

SUMMARY OF THE INVENTION

The present teachings provide a wearable dispenser device including a flexible tubular member including a first end and a second end and an interior of the flexible tubular member defining a reservoir. A first end assembly can be arranged at the first end of the tubular member and a second end assembly can be arranged at the second end of the tubular member. The first end assembly can include a valve member configured to allow a liquid to be supplied into the reservoir. The second end assembly can include a rollerball mechanism configured to allow the liquid to be accurately dispensed from the reservoir. The first end assembly is capable of being releasably secured to the second end assembly via a releasable connection thereby allowing the dispensing device to be worn about a body part of a user.

The present teachings also provide an elongated dispenser capable of being worn about a body part of a user. The elongated dispenser can include a flexible tubular member including a first end and a second end and an interior of the flexible tubular member defines a reservoir. A first end assembly can be arranged at the first end of the tubular member. A second end assembly can be arranged at the second end of the flexible tubular member and can include a rollerball mechanism configured to allow a liquid stored in the reservoir to be accurately dispensed from the reservoir when a rollerball is rolled on the user. The first end assembly is capable of being releasably secured to the second end assembly via a releasable connection after arranging the flexible tubular member about the body part of the user thereby securing the elongated dispenser to the user.

The present teachings still further provide an elongated dispenser capable of being worn about a body part of a user. The elongated dispenser can include a flexible tubular member including a first end and a second end and an interior of the flexible tubular member defines a reservoir. A first end assembly can be arranged at the first end of the tubular member. A second end assembly can be arranged at the second end of the flexible tubular member and can include a rollerball mechanism configured to allow a liquid stored in the reservoir to be accurately dispensed from the reservoir when a rollerball is rolled on the user. The flexible tubular member is capable of retaining its shape after being bent about the body part of the user thereby allowing the elongated dispenser to be secured to the body part of the user Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1:
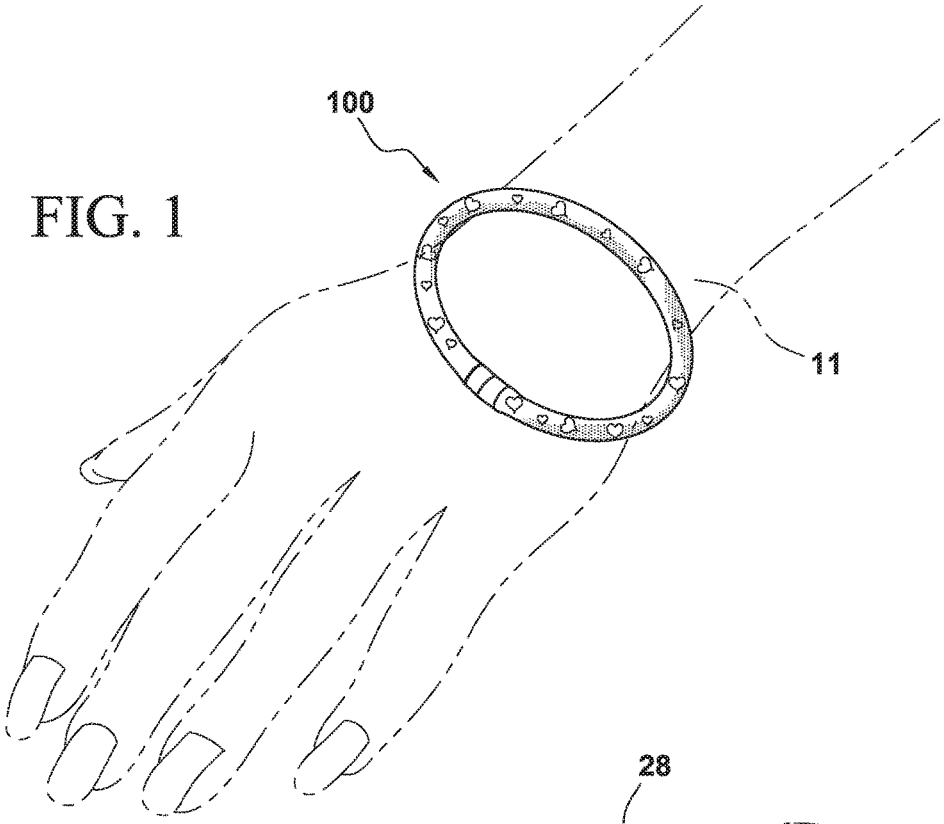
FIG. 1 shows a perspective view of a dispenser of the present teachings in a clasped position about the wrist of a user.
Figure 2:
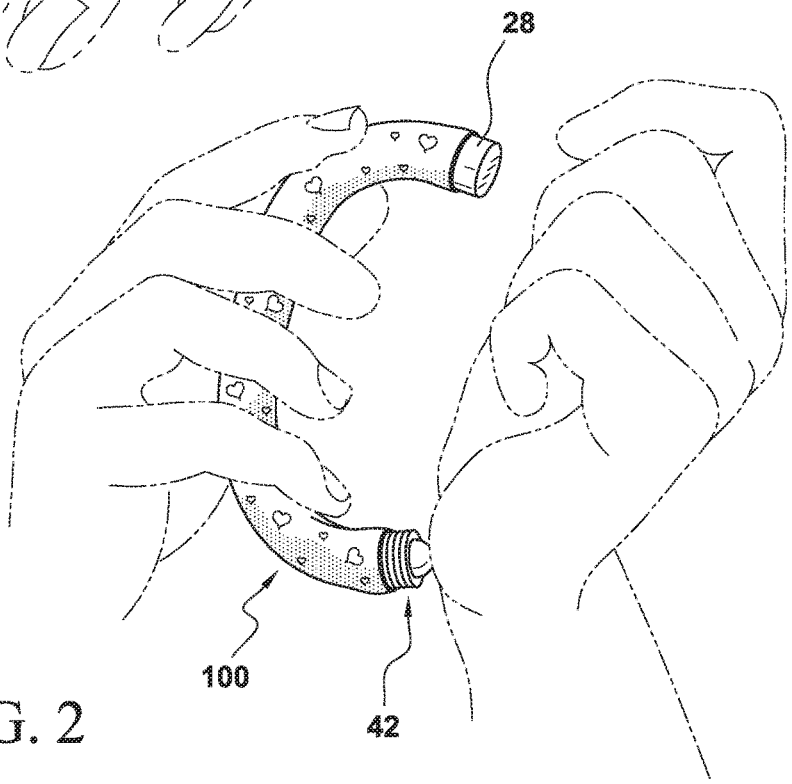
FIG. 2 shows a perspective view of the dispenser of FIG. 1 in an unclasped position and being used to apply a liquid to the wrist of a user.

Referring to FIG. 1, a dispenser 100 of the present teachings is shown and is capable of use with any liquid, such as a perfume, oil, moisturizer, lotion, and the like. The dispenser 100 of the present teachings is shown sized as a bracelet for use about a wrist of a user 11. The dispenser 100 could be sized so as to be capable of being secured about any body part, such as the neck, waist, or ankle thereby allowing the dispenser to be readily carried by the user so that it is accessible throughout the day. The dispenser 100 can also be secured about a body part of an animal or about a portion of an inanimate object, such as a backpack.

Figure 3:
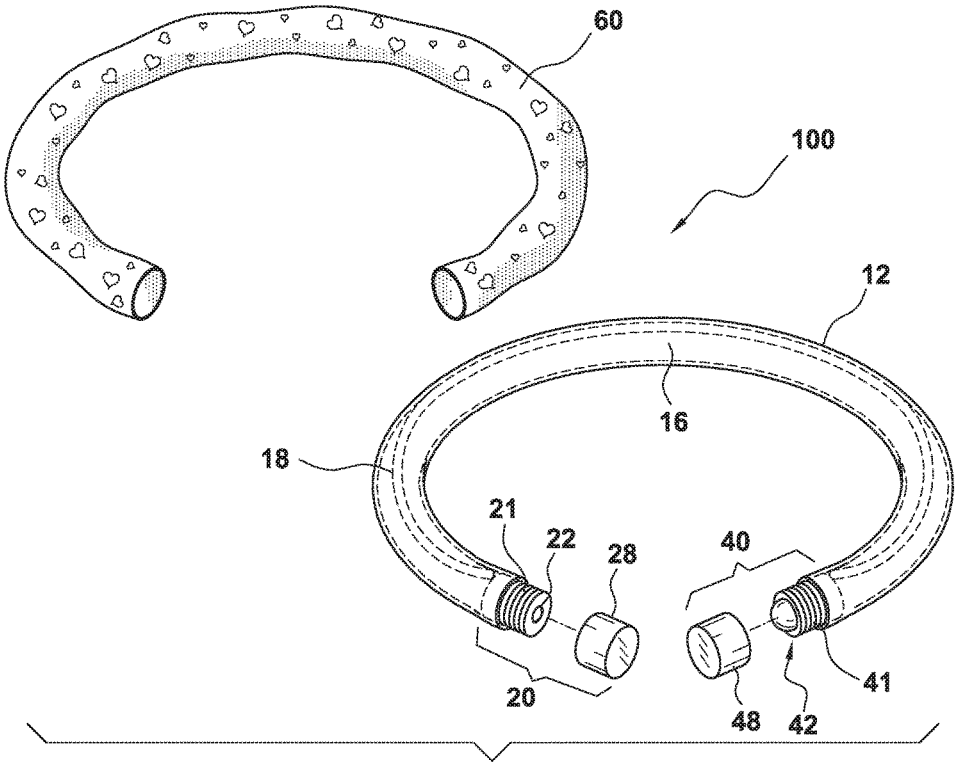
FIG. 3 shows an exploded perspective view of the dispenser of the present teachings.

Referring to FIG. 3, the dispenser 100 of the present teachings can include an elongated tubular member 12 having a first end assembly 20 arranged on one end of the elongated tubular member 12 and a second end assembly 40 arranged on the opposite end of the tubular member 12. The first end assembly 20 can include a first end member 21 and a removable cap 28. The second end assembly 40 can include a second end member 41 and a removable cap 48.

Each of the end members 21, 41 can be secured to the respective ends of the tubular member 12 by way of a friction fit or by way of any other securing arrangement. Each of the end caps 28, 48 can secure to a respective end member 21, 41 by way of a threaded connection or by way of any other releasable securing mechanism. The end caps 28, 48 can protect and keep the structure of the end members 21, 41 clean and free of contaminants while the dispenser 100 is being worn and stored.

The interior of the tubular member 12 forms a reservoir 16 that is defined by the interior walls of the tubular member 12 and by each of the end assemblies 20, 40. The reservoir 16 is initially empty and is fillable with a fluid through a valve mechanism 22 or any fluid control structure that can be formed with the first end member 21. The fluid received in the reservoir 16 can be selectively dispensed through a dispensing mechanism 42 formed with the second end member 41.

A core member 18 can be arranged within the interior of the tubular member 12. The core member 18 can be a rod which is bendable and can have the ability of retaining its shape after being bent. In use, the core member 18 can retain the general shape of the tubular member 12 after the tubular member 12 is bent into a desired position. Alternatively, the tubular member 12 can be formed of a flexible plastic material that is bendable and capable of retaining its shape thereby precluding the need for the use of a separate core member 18.

The tubular member 12 can be formed of any suitable flexible material, such as a plastic including polyvinyl chloride, polyurethane, polypropylene, polyethylene, ethyl vinyl acetate, and the like. In a preferred embodiment, the tubular member 12 can be formed of a clear transparent material. However, the tubular member 12 could also be made from a material that is opaque.

Figure 4:
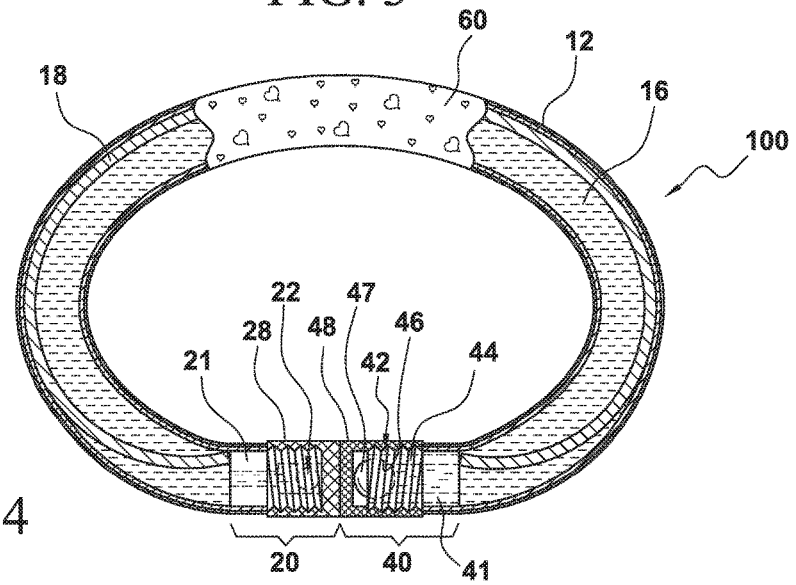
FIG. 4 shows a cross-sectional top view of the dispenser of the present teachings.

Referring to FIGS. 1 and 4, the tubular member 12 can be readily bent into the shape of a ring so that the dispenser 100 can be worn as a bracelet, for example. To secure the ends of the tubular member 12 together, each of the end assemblies 20, 40 can be arranged to be selectively securable to one another. For example, one or more of the end caps 28, 48 can be magnetized so they can readily secure to one another after the dispenser 100 is arranged about the body part of the user. Later, the end caps 28, 48 can be forced apart when it is desired to remove the dispenser 100 from the body. Moreover, two or more dispensers 100 can be secured in series by way of the end caps 28, 48 to create a multiple reservoir dispenser 100.

According to various embodiments, the dispenser 100 can include end assemblies 20, 40 that are not selectively securable to one another and the dispenser 100 can secure to the body part of the user by the tubular member 12 retaining its shape after being bent about the body part.

As best shown in FIGS. 3 and 4, an interchangeable and removable sleeve 60 can be arranged about the tubular member 12. The sleeve 60 can be made of a fabric, metal, or leather, for example. The sleeve 60 can be colored and/or imprinted with a fashionable design so that the dispenser 100 of the present teachings can be matched with its environment, such as, with an outfit being worn by the user or with current fashion or pop culture trends.

The first end member 20 can include a valve mechanism 22 or other fluid control mechanism that allows a liquid to be transferred into the reservoir 16 from a separate supply source. In this manner, the first end member 20 can act as a fill valve to allow the dispenser 100 to be filled and then later re-filled with a fluid. The valve mechanism 22 can also prevent the liquid stored within the reservoir 16 from leaking.

The second end member 40 is arranged on the opposite end of the tubular member 12 and can include the dispensing mechanism 42. The dispensing mechanism 42 can operate to allow the liquid to be selectively and accurately dispensed from the reservoir 16. For example, the dispensing mechanism 42 can include a rollerball applicator that allows a thin coating of the liquid to be evenly rolled onto the user as discussed in more detail below.

As shown in FIG. 4, the rollerball applicator 42 can include an annular seat member 44 forming a seating surface 46. The annular seat member 44 can form a portion of the second end member 41. A rollerball 47 can be rotationally constrained with the annular seat member 44. In an alternate embodiment, the annular seat member 44 can be formed to include a plurality of seating surfaces 46 each supporting a respective rollerball 47. In this manner, the dispensing mechanism 42 could include a plurality of rollerball applicators.

When it is desired to use the dispenser 100 of the present teachings to apply the stored liquid to a surface, such as the skin of the user, the end caps 28, 48 are initially separated therefrom. The end cap 48 protecting the rollerball applicator 42 of the second end member 40 is then removed from the second end member 40 thereby exposing the rollerball 47. The rollerball 47 can then be applied to the skin and rolled there along. When the rollerball 47 becomes relatively dry, the dispenser 100 can be tipped in a manner such that the liquid within the reservoir 16 communicates with the exposed portion of the rollerball 47, as shown in FIG. 3. This coats the rollerball 47 with liquid from the reservoir 16 and transmits the liquid between the annular seat member 44 and the rollerball 47 to the skin along which the rollerball 47 is rolled. In this manner, the rollerball 47 allows the liquid to be rolled on neatly and accurately onto the skin of the user.

As the liquid is depleted from the reservoir 16, a vacuum is not created within the reservoir 16 since air is allowed to pass between the rollerball 47 and the annular seat member 44 of the second end member 40. At the same time, the rollerball applicator 42 prevents liquid from leaking from the reservoir 16.

After a desired amount of liquid is rolled onto the skin of the user, the end cap 48 can be re-secured to the second end assembly 40. The tubular member 12 can be re-arranged about the wrist and the end caps 28, 48 re-connected to one another thereby allowing the dispenser 100 to be worn as a bracelet again.

According to various embodiments, the tubular member 12 can have an outer diameter of about 0.8 centimeters to about 1.2 centimeters, and preferably about 1 centimeter. The tubular member 12 can have an interior diameter of about 0.7 centimeters to about 0.9 centimeters, and preferably about 0.8 centimeters.

For use as a bracelet about a typical wrist, the tubular member 12 can be have a length of about 6 to about 8 inches, and preferably about 7 inches, and can hold approximately 3.5 mL of liquid within. For use as a necklace on the neck, the tubular member 12 can have a length of about 13 to about 15 inches, and preferably about 14 inches, and can hold approximately 7 mL of liquid within.

The dispenser 100 of the present teachings thereby provides a rollerball applicator with a wearable product to provide a user with a way of traveling with a liquid, such as a perfume, which allows easy and accurate application of the stored liquid onto the skin while also simultaneously being a style accessory.

Those skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. A wearable dispenser device comprising:

a flexible tubular member including a first end and a second end and an interior of the flexible tubular member defining a reservoir;

a first end assembly arranged at the first end of the tubular member; and a second end assembly arranged at the second end of the tubular member;

wherein the first end assembly includes a valve member configured to allow a liquid to be supplied into the reservoir and a first end cap arranged with the valve member;

wherein the second end assembly includes a rollerball mechanism configured to allow the liquid to be accurately dispensed from the reservoir and a second end cap capable of being secured about the rollerball mechanism; and wherein the first end cap of the first end assembly is capable of being releasably secured to the second end cap of the second end assembly via a releasable connection thereby allowing the dispensing device to be worn about a body part of a user.

2. The wearable dispenser device of claim 1, wherein the releasable connection between the first end cap and the second end cap is a magnetic connection.

3. The wearable dispenser device of claim 1, further comprising a bendable core member arranged within the interior of the flexible tubular member and configured to retain the general shape of the flexible tubular member after the flexible tubular member is bent into a desired position.

4. The wearable dispenser device of claim 1, wherein the flexible tubular member is capable of retaining its shape after being bent into a desired position.

5. The wearable dispenser device of claim 1, wherein the rollerball mechanism includes an annular seat member having a seating surface and a rollerball rotationally held with the seating surface.

6. The wearable dispenser device of claim 1, further comprising a sleeve arranged about the flexible tubular member.

7. An elongated dispenser capable of being worn about a body part of a user comprising:

a flexible tubular member including a first end and a second end and an interior of the flexible tubular member defining a reservoir;

a first end assembly arranged at the first end of the tubular member and including a first end cap; and a second end assembly arranged at the second end of the flexible tubular member and including a rollerball mechanism configured to allow a liquid stored in the reservoir to be accurately dispensed from the reservoir when a rollerball is rolled on the user, the second end assembly further including a second end cap capable of being secured about the rollerball mechanism;

wherein the first end assembly is capable of being releasably secured to the second end cap of the second end assembly via a releasable connection after arranging the flexible tubular member about the body part of the user thereby securing the elongated dispenser to the user.

8. The elongated dispenser of claim 7, wherein the releasable connection between the first end assembly and the second end cap of the second end assembly is a magnetic connection.

9. The elongated dispenser of claim 7, further comprising a bendable core member arranged within the interior of the flexible tubular member and configured to retain the general shape of the flexible tubular member after the flexible tubular member is bent into a desired position.

10. The elongated dispenser of claim 7, wherein the flexible tubular member is capable of retaining its shape after being bent into a desired position.

11. The elongated dispenser of claim 7, wherein the rollerball mechanism includes an annular seat member having a seating surface and a rollerball rotationally held with the seating surface.

12. The elongated dispenser of claim 7, further comprising a sleeve arranged about the flexible tubular member.

13. An elongated dispenser capable of being worn about a body part of a user comprising:

a flexible tubular member including a first end and a second end and an interior of the flexible tubular member defining a reservoir;

a first end assembly arranged at the first end of the tubular member and including a first end cap; and a second end assembly arranged at the second end of the flexible tubular member and including a rollerball mechanism configured to allow a liquid stored in the reservoir to be accurately dispensed from the reservoir when a rollerball is rolled on the user, the second end assembly further including a second end cap capable of being secured about the rollerball mechanism;

wherein the flexible tubular member is capable of retaining its shape after being bent about the body part of the user thereby allowing the elongated dispenser to be secured to the body part of the user.

14. The elongated dispenser of claim 13, further comprising a bendable core member arranged within the interior of the flexible tubular member, the bendable core allowing the flexible tubular member to retain its shape after being bent about the body part of the user.

15. The elongated dispenser of claim 13, wherein the rollerball mechanism includes an annular seat member having a seating surface and a rollerball rotationally held with the seating surface.

16. The elongated dispenser of claim 13, further comprising a sleeve arranged about the flexible tubular member.

17. The elongated dispenser of claim 13, wherein the first end assembly includes a one-way valve configured to allow a liquid to be supplied into the reservoir.

* * * * *